US007838470B2

(12) United States Patent
Shaw et al.

(10) Patent No.: US 7,838,470 B2
(45) Date of Patent: Nov. 23, 2010

(54) LUBRICATING OIL COMPOSITION

(75) Inventors: Robert W. Shaw, Oxfordshire (GB); Ian A. W. Bell, Oxfordshire (GB); Robert Robson, Oxfordshire (GB)

(73) Assignee: Infineum International Limited, Oxfordshire (GB)

( * ) Notice: Subject to any disclaimer, the term of this patent is extended or adjusted under 35 U.S.C. 154(b) by 837 days.

(21) Appl. No.: 10/909,141

(22) Filed: Jul. 30, 2004

(65) Prior Publication Data

US 2005/0070444 A1 Mar. 31, 2005

(30) Foreign Application Priority Data

Aug. 7, 2003 (EP) ..... 03254961

(51) Int. Cl.
*C10M 143/06* (2006.01)
*C10M 133/16* (2006.01)
*C10M 169/04* (2006.01)

(52) U.S. Cl. ..... 508/110; 508/591; 508/291

(58) Field of Classification Search ..... 508/110, 508/291, 591
See application file for complete search history.

(56) References Cited

U.S. PATENT DOCUMENTS 3,664,955 A * 5/1972 Panzer ..... 508/335
3,953,179 A * 4/1976 Souillard et al. ..... 44/389
3,994,815 A * 11/1976 Coleman ..... 508/591
5,137,980 A * 8/1992 DeGonia et al. ..... 525/327.6
5,436,379 A 7/1995 Heilman et al. ..... 585/10
5,498,355 A 3/1996 Perozzi et al. ..... 252/49.6
5,736,490 A * 4/1998 Bouffet et al. ..... 508/272
6,300,290 B1 * 10/2001 L'Heureux et al. ..... 508/287
6,441,110 B1 * 8/2002 Sigwart et al. ..... 526/104
6,649,576 B2 * 11/2003 Bell et al. ..... 508/481
6,846,782 B2 * 1/2005 Calder ..... 508/293
2002/0019320 A1 * 2/2002 Nakazato et al. ..... 508/159
2004/0180797 A1 * 9/2004 Huffer et al. ..... 508/232

FOREIGN PATENT DOCUMENTS

EP 0 331 359 B1 5/1992
EP 0 280 260 B1 8/1992
EP 0 393 768 B1 2/1993
WO WO 95/06701 A1 3/1995
WO WO 02092645 A1 * 11/2002

* cited by examiner

*Primary Examiner*—Glenn Caldarola
*Assistant Examiner*—Jim Goloboy

(57) ABSTRACT

A multigrade crankcase lubricating oil composition comprising a mineral oil-based basestock of lubricating viscosity in a major amount and a non-hydrogenated olefin polymer in a minor amount. The lubricating oil composition also comprises a dispersant, a metal detergent, one or more other additives, and a viscosity modifier.

16 Claims, No Drawings

LUBRICATING OIL COMPOSITION

This invention relates to lubricating oil compositions, such as multigrade lubricants that give enhanced performance in engine piston cleanliness, particularly for diesel engines.

Lubricating oil compositions (or lubricants) for the crankcase of internal combustion engines are well-known and it is also well-known for them to contain additives (or additive components) to enhance their properties and performance.

Increasingly, the demands of original equipment manufacturers (OEMs) to meet performance criteria dictate the properties of lubricants. One such performance criterion concerns the cleanliness of pistons during operation of a compression-ignited (diesel) internal combustion engine. This may be measured by the VWTDi test (CEC L-78-T-99).

Other performance criteria of interest include the volatility of the lubricant, the fuel economy performance of the lubricant, and the chlorine content of the lubricant. Also of increasing importance, because of environmental concerns, are the sulphated ash, phosphorus and sulphur contents of a lubricant.

The various criteria clearly constrain formulators of lubricants in terms of additive components and amounts, and of basestocks, that may be used.

U.S. Pat. No. 5,436,379 describes fully synthetic lubricating base oil compositions formulated from 50-97 wt % of synthetic hydrocarbons and 3-50 wt % isobutylene oligomers, and their formulation into fully synthetic lubricating compositions. The specification states that the performance of multi-grade oils based on a mineral oil is highly unsatisfactory for a number of reasons.

It has now been found that use of a minor amount of a non-hydrogenated olefin polymer, for example, a polyisobutene, in a lubricating oil composition based on mineral oil surprisingly improves the cleanliness of pistons in internal combustion engines. Further, an advantage of using such a polymer is that the amount of viscosity index improver may be reduced while maintaining the viscometric grade.

In a first aspect, the invention is a multigrade crankcase lubricating oil composition, preferably for a compression-ignition engine, especially for a passenger car compression-ignition engine, comprising, or made by admixing:

(A) a major amount of oil of lubricating viscosity at least 50, such as at least 60% by mass of which is a mineral oil; and minor amounts of:

(B) a non-hydrogenated olefin polymer in an amount of 1 to 15, preferably 2 to less than 10, such as 3 to 8, mass %, based on the mass of the oil composition, said polymer having a number average molecular weight in the range of 100 to 5,000;

(C) a dispersant, such as an ashless dispersant;

(D) a metal detergent, such as a calcium and/or magnesium detergent;

(E) one or more other lubricant additive components selected from anti-oxidants, anti-wear agents and friction modifiers; and (F) a viscosity modifier.

In a second aspect, the invention is a method of lubricating a compression-ignited internal combustion engine comprising operating the engine and lubricating the engine with a lubricating oil composition according to the first aspect.

In a third aspect, the invention is a method of improving piston cleanliness of a compression-ignited internal combustion engine comprising adding to the engine a lubricating oil composition according to the first aspect.

In a fourth aspect, the invention is a combination of a compression-ignited internal combustion engine, preferably having a specific power output of 25 kW/liter or greater, and a lubricating oil composition according to the first aspect.

In a fifth aspect, the invention is the use of a non-hydrogenated olefin polymer in a multigrade crankcase lubricating oil composition to improve the piston cleanliness of a compression-ignited internal combustion engine.

In a sixth aspect, the invention is a concentrate for preparing a multigrade crankcase lubricating oil composition defined in the first aspect comprising an oleaginous carrier, a non-hydrogenated olefin polymer, a dispersant, a metal detergent, and one or more other lubricant additive components selected from anti-oxidants, anti-wear agents and friction modifiers.

The features of the invention will now be discussed in more detail as follows:

Lubricating Oil Compositions

The lubricating oil compositions of the present invention are for lubricating the crankcase of an internal combustion engine, preferably a compression-ignited (diesel) engine, more preferably a compression-ignited passenger vehicle engine. Crankcase lubricating oil compositions for a diesel application, in particular for passenger vehicles, have to be specifically formulated to meet the performance requirements of such an application.

It is preferred that lubricating oil compositions of the invention are multigrade oil compositions having a viscometric grade of SAE 10W-X, SAE 5W-X and SAE 0W-X, where X represents 20, 30 and 40, the characteristics of which grades being provided in the SAE J300 classification. It is especially preferred that the lubricating oil compositions have a viscometric grade of SAE 5W-X and SAE 0W-X, where X represents 20, 30 and 40, advantageously 20 and 30.

In another embodiment of the present invention, the lubricating oil compositions of the first aspect have a NOACK volatility of at most 15, such as less than 13, preferably less than 11, such as 7 to 10, mass %, as determined according to CEC L-40-A-93. The NOACK volatility of the lubricating oil composition is generally not less than 4, such as not less than 5 mass %.

Further, the lubricating oil compositions of the invention preferably have 0.005 to 0.08, such as 0.01 to 0.07, especially 0.03 to 0.06, mass % of phosphorus, preferably derived from one or more zinc dithiophosphate additives, based on the mass of the oil composition.

Independently of the other embodiments, the sulfur content of lubricating oil compositions of the invention is preferably 0.05 to 0.4, especially 0.1 to 0.3, advantageously 0.15 to 0.2, mass %, based on the mass of the oil composition.

In an embodiment, the lubricating oil composition of the invention gives a sulfated ash value of at most 1.0, for example, 0.2 to 0.8, preferably 0.3 to 0.6, mass %, based on the mass of the oil composition.

The lubricating oil composition may also have a molybdenum content of at most 300, preferably in the range 10 to 200, especially 50 to 175, ppm by mass, based on the mass of the oil composition.

Also, a boron-containing additive may be present in the lubricating oil composition, wherein the amount of boron therein is preferably at most 150, preferably in the range 10 to 100, especially 25 to 75, ppm by mass, based on the mass of the oil composition.

The amounts of phosphorus, sulfur, molybdenum and of boron are determined according to method ASTM D5185; "TBN" is Total Base Number as measured by ASTM D2896; the amount of nitrogen is determined according to method ASTM D4629; and the amount of sulfated ash is measured according to method ASTM D874.

The lubricating oil composition preferably satisfies at least the performance requirements of ACEA B2-98, more preferably at least the ACEA B1-02, such as at least the ACEA B3-02, especially ACEA B4-02 and ACEA B5-02, for light duty diesel engines.

Oil of Lubricating Viscosity

The oil of lubricating viscosity is the major liquid constituent of a lubricating oil composition. The oil of lubricating viscosity includes (a) oil added to an additive concentrate or additive package, and (b) any oil present in an additive concentrate or additive package.

As stated, at least 50% by mass of the oil of lubricating viscosity is a mineral oil; it may be selected from Group I, II and III basestocks, and mixtures thereof. The balance may comprise synthetic basestocks selected from Group IV and V basestocks and mixtures thereof. For example, at least 60, 70, 80, 90 or 95, % by mass, or all, of the oil of lubricating viscosity may be a mineral oil.

Basestocks may be made using a variety of different processes including but not limited to distillation, solvent refining, hydrogen processing, oligomerization, esterification, and rerefining.

American Petroleum Institute (API) 1509 "Engine Oil Licensing and Certification System" Fourteenth Edition, December 1996 states that all basestocks are divided into five general categories:

Group I basestocks contain less than 90% saturates and/or greater than 0.03% sulfur and have a viscosity index greater than or equal to 80 and less than 120;

Group II basestocks contain greater than or equal to 90% saturates and less than or equal to 0.03% sulfur and have a viscosity index greater than or equal to 80 and less than 120;

Group III basestocks contain greater than or equal to 90% saturates and less than or equal or 0.03% sulfur and have a viscosity index greater than or equal to 120;

Group IV basestocks are polyalphaolefins (PAO); and

Group V basestocks contain all other basestocks not included in Group I, II, III or IV, and include for example, alkylcyclopentane sold under the trade name Pennzoil.

Group IV basestocks, i.e. polyalphaolefins (PAO), are, as noted above, generally hydrogenated oligomers of an alpha-olefin, the most important methods of oligomerization being free radical processes, Ziegler catalysis, cationic, and Friedel-Crafts catalysis.

Group V basestocks, if used, may be in the form of esters. Examples include polyol esters such as pentaerythritol esters, trimethylolpropane esters and neopentylglycol esters; diesters; $C_{36}$ dimer acid esters; trimellitate esters, i.e. 1,2,4-benzene tricarboxylates; and phthalate esters, i.e. 1,2-benzene dicarboxylates. The acids from which the esters are made are preferably monocarboxylic acids of the formula $RCO_2H$ where R represents a branched, linear or mixed alkyl group. Such acids may, for example, contain 6 to 18 carbon atoms.

Preferably the oil of lubricating viscosity contains at most 0.1, such as at most 0.05, more preferably 0.005 to 0.03, mass % of sulfur, based on the mass of the oil.

Especially preferred is an oil of lubricating viscosity comprising a Group III basestock, advantageously in an amount of at least 20, such as at least 40, more preferably in the range from 55 to 90, mass %, based on the mass of the oil composition.

In a preferred embodiment, the oil of lubricating viscosity comprises a Group III basestock and a Group V basestock in the form of an ester. The amount of Group V basestock in the form of an ester is preferably at most 15, such as 0.5 to 15, more preferably 1 or 2 to 15, especially 3 to 15, more especially 3 to 10, advantageously 3 to 8, such as 5 to 8, mass %, based on the mass of the oil composition. A Group I, Group II or Group IV basestock or any mixture thereof may also be present, in a minor amount, in the oil of lubricating viscosity as a diluent or carrier fluid for the additive components and additive concentrate(s) used in preparing the lubricating oil compositions of the invention. More preferably, the oil of lubricating viscosity consists essentially of Group III basestocks and Group V basestocks in the form of an ester, but may contain minor amounts, such as at most 25, such as at most 20, preferably at most 10, advantageously at most 5, mass %, based on the mass of the total oil, of other basestocks, such as a Group I, Group II or Group IV basestock or any mixture thereof.

The test methods used in defining the above groups are ASTM D2007 for saturates; ASTM D2270 for viscosity index; and one of ASTM D2622, 4294, 4927 and 3120 for sulfur.

Non-Hydrogenated Olefin Polymer

The non-hydrogenated olefin polymer is preferably a polymer of one or more acyclic olefin monomers. Generally, the non-hydrogenated olefin polymers useful in the invention have about one double bond, preferably have one double bond, per polymer chain.

"Non-hydrogenated" means that the polymer contains one or more sites of unsaturation such as carbon-carbon double bonds and distinguishes the polymers employed in the present invention from those commonly referred to as polyalphaolefins (or PAO's) which, in the context of lubricants, are hydrogenated oligomers of $\alpha$-olefins such as $\alpha$-decene. "Chemistry and Technology of lubricants", Edited by Mortier and Orszulik, pages 33 to 40 (Second Edition) discusses PAO's and polybutenes and state that polyisobutylene (or PIB), which may be employed in the present invention "shows substantially different properties to the PAO-type lubricants".

The polymer may be prepared by polymerizing an alpha-olefin monomer, or mixtures of alpha-olefin monomers, or mixtures comprising ethylene and at least one $C_3$ to $C_{28}$ alpha-olefin monomer, in the presence of a catalyst system comprising at least one metallocene (e.g., a cyclopentadienyl-transition metal compound) and an alumoxane compound. Using this process, a polymer in which 95% or more of the polymer chains possess terminal ethenylidene-type unsaturation can be provided. The percentage of polymer chains exhibiting terminal ethenylidene unsaturation may be determined by FTIR spectroscopic analysis, titration, or $C^{13}$ NMR. Interpolymers of this latter type may be characterized by the formula POLY-C($R^1$)=$CH_2$ wherein $R^1$ is $C_1$ to $C_{26}$ alkyl, preferably $C_1$ to $C_{18}$ alkyl, more preferably $C_1$ to $C_8$ alkyl, and most preferably $C_1$ to $C_2$ alkyl, (e.g., methyl or ethyl) and wherein POLY represents the polymer chain. The chain length of the $R^1$ alkyl group will vary depending on the comonomer(s) selected for use in the polymerization. A minor amount of the polymer chains can contain terminal ethenyl, i.e. vinyl, unsaturation, i.e. POLY-CH=$CH_2$, and a portion of the polymers can contain internal monounsaturation, e.g., POLY-CH=CH($R^1$), wherein $R^1$ is as defined above. These terminally unsaturated interpolymers may be prepared by known metallocene chemistry and may also be prepared as described in U.S. Pat. Nos. 5,498,809; 5,663,130; 5,705,577; 5,814,715; 6,022,929 and 6,030,930.

Another useful class of polymers is that constituted by polymers prepared by cationic polymerization of, e.g., isobutene, or styrene. Common polymers from this class include polyisobutenes obtained by polymerization of a $C_4$ refinery stream having a butene content of 35 to 75% by wt., and an isobutene content of 30 to 60% by wt., in the presence of a Lewis acid catalyst, such as aluminum trichloride or boron trifluoride, aluminium trichloride being preferred. Preferred sources of monomer for making poly-n-butenes are petroleum feedstreams such as Raffinate II. These feedstocks are disclosed in the art such as in U.S. Pat. No. 4,952,739. Polyisobutylene is a most preferred polymer of the present invention because it is readily available by cationic polymerization from butene streams (e.g., using $AlCl_3$ or $BF_3$ catalysts). Such polyisobutylenes generally contain residual unsaturation in amounts of about one ethylenic double bond per polymer chain, positioned along the chain. A preferred embodiment utilizes polyisobutylene prepared from a pure isobutylene stream or a Raffinate I stream to prepare reactive isobutylene polymers with terminal vinylidene olefins. Preferably, these polymers, referred to as highly reactive polyisobutylene (HR-PIB), have a terminal vinylidene content of at least 65%, e.g., 70%, more preferably at least 80%, most preferably, at least 85%. The preparation of such polymers is described, for example, in U.S. Pat. No. 4,152,499. HR-PIB is known and HR-PIB is commercially available under the tradenames Glissopal™ (from BASF) and Ultravis™ (from BP-Amoco).

In another embodiment, the non-hydrogenated olefin polymer, for example, polyisobutylene, has at most 10, such as 5 to 10, % of the polymer chains possessing a terminal double bond (or terminal ethenylidene-type or terminal vinylidene unsaturation). Such a polymer is considered not highly reactive. An example of a commercially available polymer is that sold under tradename Napvis™ (from BP-Amoco), and usually obtained by polymerization with aluminium trichioride as catalyst.

Preferably the polymer is derived from polymerisation of one or more olefins having 2 to 10, such as 3 to 8, carbon atoms. An especially preferred olefin is butene, advantageously isobutene.

The number average molecular weight of the non-hydrogenated olefin polymer useful in the present invention is preferably in the range that commences at 100; 300 or 800 and that terminates at 2400; 2500; 2700; 3000 or 5000. A preferred range is 300 to 3000, more preferably 800 to 2500. The above commencement and termination values may be independently combined. The molecular weight can be determined by several known techniques. A convenient method for such determination is by gel permeation chromatography (GPC), which additionally provides molecular weight distribution information; see W. W. Yau, J. J Kirkland and D. D Bly, "Modern Size Exclusion Liquid Chromatography", John Wiley and Sons, New York, 1979.

Further, the kinematic viscosity at 100° C., as measured according to ASTM D445, of the non-hydrogenated olefin polymer is at least 9 or 15, such as 100 or 150 to 3000, advantageously 200 to 2700 or 2500, $mm^2s^{-1}$.

In an embodiment, a polyisobutylene polymer having a number average molecular weight of 200 to 2400 and a kinematic viscosity at 100° C. of 200 to 2500 $mm^2s^{-1}$ was found to demonstrate beneficial properties.

Dispersant Additive

Dispersants (or dispersant additives), such as ashless (i.e. metal-free) dispersants, hold solid and liquid contaminants, resulting from oxidation during use, in suspension and thus prevent sludge flocculation and precipitation or deposition on metal parts. They comprise long-chain hydrocarbons, to confer oil-solubility, with a polar head capable of associating with particles to be dispersed. A noteworthy group is provided by hydrocarbon-substituted succinimides.

Generally, ashless dispersants form substantially no ash on combustion, in contrast to metal-containing (and thus ash-forming) detergents. Borated metal-free dispersants are also regarded herein as ashless dispersants. "Substantially no ash" means that the dispersant may give trace amounts of ash on combustion, but in amounts which do not have practical or significant effect on the performance of the dispersant.

A dispersant additive composition contains two or more dispersants.

The ashless dispersants of the present invention comprise an oil-soluble polymeric long chain backbone having functional groups capable of associating with particles to be dispersed. Typically, such dispersants have amine, amine-alcohol or amide polar moieties attached to the polymer backbone, often via a bridging group. The ashless dispersant may be, for example, selected from oil-soluble salts, esters, amino-esters, amides, imides and oxazolines of long chain hydrocarbon-substituted mono- and polycarboxylic acids or anhydrides thereof; thiocarboxylate derivatives of long chain hydrocarbons; long chain aliphatic hydrocarbons having polyamine moieties attached directly thereto; and Mannich condensation products formed by condensing a long chain substituted phenol with formaldehyde and polyalkylene polyamine. Suitable dispersants include, for example, derivatives of long chain hydrocarbyl-substituted carboxylic acids, in which the hydrocarbyl group has a number average molecular weight of less than 15,000, such as less than 5,000, examples of such derivatives being derivatives of high molecular weight hydrocarbyl-substituted succinic acid. Such hydrocarbyl-substituted carboxylic acids may be derivatised with, for example, a nitrogen-containing compound, advantageously a polyalkylene polyamine or amine-alcohol or amide or ester. Particularly preferred dispersants are the reaction products of polyalkylene amines with alkenyl succinic anhydrides. Examples of specifications disclosing dispersants of the last-mentioned type are U.S. Pat. Nos. 3,202,678, 3,154,560, 3,172,892, 3,024,195, 3,024,237, 3,219,666, 3,216,936 and BE-A-662 875.

The dispersant(s) of the present invention are preferably non-polymeric (e.g., are mono- or bis-succinimides).

The dispersant(s) of the present invention may optionally be borated. Such dispersants can be borated by conventional means, as generally taught in U.S. Pat. Nos. 3,087,936, 3,254,025 and 5,430,105. Boration of the dispersant is readily accomplished by treating an acyl nitrogen-containing dispersant with a boron compound such as boron oxide, boron halide boron acids, and esters of boron acids, in an amount sufficient to provide from 0.1 to 20 atomic proportions of boron for each mole of acylated nitrogen composition.

An ashless succinimide or a derivative thereof, obtainable from a polyisobutenylsuccinic anhydride produced from polybutene and maleic anhydride by a thermal reaction method using neither chlorine nor a chlorine atom-containing compound, is a preferred dispersant.

Dispersancy may be provided by polymeric compounds capable of providing viscosity index improving properties and dispersancy. Such compounds are known as dispersant viscosity index improver additives or a multifunctional viscosity index improvers. Such polymers differ from conventional viscosity index improvers in that they provide performance properties, such as dispersancy and/or antioxidancy, in addition to viscosity index improvement (see below under viscosity modifiers for further discussion of multifunctional viscosity modifiers). If a dispersant viscosity index improver additive is used in the present invention, a dispersant additive is also present.

Advantageously, the dispersant additive composition contains one or more dispersants, preferably a borated and non-borated dispersant.

Typically, one or more dispersants are used in a lubricating oil composition in such an amount that they provide 0.01 to 0.12, preferably 0.03 to 0.09, especially 0.05 to 0.07, mass % of nitrogen, based on the mass of the oil composition.

Detergent Additive

A detergent (or detergent additive) reduces formation of piston deposits, for example high-temperature varnish and lacquer deposits, by keeping finely divided solids in suspension in engines; it may also have acid-neutralising properties. A detergent comprises metal salts of organic acids, which are referred herein as soaps or surfactants.

A detergent has a polar head, i.e. the metal salt of the organic acid, with a long hydrophobic tail for oil solubility. Therefore, the organic acids typically have one or more functional groups, such as OH or COOH or $SO_3H$, for reacting with a metal, and a hydrocarbyl substituent. A detergent may be overbased, in which case the detergent contains an excess of metal in relation to the stoichiometric quantity needed for the neutralisation of the organic acid. This excess is in the form of a colloidal dispersion, typically metal carbonate and/or hydroxide, with the metal salts of organic acids in a micellar structure.

Examples of organic acids include sulfonic acids, phenols and sulfurised derivatives thereof, and carboxylic acids including aromatic carboxylic acids.

Phenols may be non-sulfurized or, preferably, sulfurized. Further, the term "phenol" as used herein includes phenols containing more than one hydroxyl group (for example, alkyl catechols) or fused aromatic rings (for example, alkyl naphthols) and phenols which have been modified by chemical reaction, for example, alkylene-bridged phenols and Mannich base-condensed phenols; and saligenin-type phenols (produced by the reaction of a phenol and an aldehyde under basic conditions).

Preferred phenols are of the formula

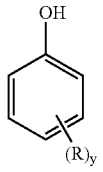

where R represents a hydrocarbyl group and y represents 1 to 4. Where y is greater than 1, the hydrocarbyl groups may be the same or different.

The phenols are frequently used in sulfurized form. Details of sulfurization processes are known to those skilled in the art; for example, see U.S. Pat. Nos. 4,228,022 and 4,309,293.

In the above formula, hydrocarbyl groups represented by R are advantageously alkyl groups, which advantageously contain 5 to 100, preferably 5 to 40, especially 9 to 12, carbon atoms, the average number of carbon atoms in all of the R groups preferably being at least 9 in order to ensure adequate solubility in oil. Preferred alkyl groups are nonyl (e.g. tripropylene) groups or dodecyl (e.g. tetrapropylene) groups.

As indicated above, the term "phenol" as used herein includes phenols which have been modified by chemical reaction with, for example, an aldehyde, and Mannich base-condensed phenols.

Aldehydes with which phenols may be modified include, for example, formaldehyde, propionaldehyde and butyraldehyde. The preferred aldehyde is formaldehyde. Aldehyde-modified phenols suitable for use in accordance with the present invention are described in, for example, U.S. Pat. No. 5,259,967 and WO 01/74751.

Mannich base-condensed phenols are prepared by the reaction of a phenol, an aldehyde and an amine. Examples of suitable Mannich base-condensed phenols are described in GB-A-2 121 432.

In general, the phenols may include substituents other than those mentioned above. Examples of such substituents are methoxy groups and halogen atoms.

A preferred phenol is a sulfurised derivative thereof.

Sulfonic acids are typically obtained by sulfonation of hydrocarbyl-substituted, especially alkyl-substituted, aromatic hydrocarbons, for example, those obtained from the fractionation of petroleum by distillation and/or extraction, or by the alkylation of aromatic hydrocarbons. The alkylaryl sulfonic acids usually contain from 22 to 100 or more carbon atoms. The sulfonic acids may be substituted by more than one alkyl group on the aromatic moiety, for example they may be dialkylaryl sulfonic acids. Preferably the sulfonic acid has a number average molecular weight of 350 or greater, more preferably 400 or greater, especially 500 or greater, such as 600 or greater. Number average molecular weight may be determined by ASTM D3712.

Another type of sulfonic acid which may be used in accordance with the invention comprises alkyl phenol sulfonic acids. Such sulfonic acids can be sulfurized.

Carboxylic acids include mono- and dicarboxylic acids. Preferred monocarboxylic acids are those containing 8 to 30, especially 8 to 24, carbon atoms. (Where this specification indicates the number of carbon atoms in a carboxylic acid, the carbon atom(s) in the carboxylic group(s) is/are included in that number). Examples of monocarboxylic acids are iso-octanoic acid, stearic acid, oleic acid, palmitic acid and behenic acid. Iso-octanoic acid may, if desired, be used in the form of the mixture of C8 acid isomers sold by Exxon Chemical under the trade name "Cekanoic". Other suitable acids are those with tertiary substitution at the α-carbon atom and dicarboxylic acids with 2 or more carbon atoms separating the carboxylic groups.

Further, dicarboxylic acids with more than 35 carbon atoms, for example, 36 to 100 carbon atoms, are also suitable. Unsaturated carboxylic acids can be sulfurized.

A preferred type of carboxylic acid is an aromatic carboxylic acid. The aromatic moiety of the aromatic carboxylic acid can contain heteroatoms, such as nitrogen and oxygen. Preferably, the moiety contains no heteroatoms; more preferably the moiety contains six or more carbon atoms; for example benzene is a preferred moiety. The aromatic carboxylic acid may contain one or more aromatic moieties, such as one or more benzene rings, either fused or connected via alkylene bridges.

The carboxylic moiety may be attached directly or indirectly to the aromatic moiety. Preferably the carboxylic acid group is attached directly to a carbon atom on the aromatic moiety, such as a carbon atom on the benzene ring.

More preferably, the aromatic moiety also contains a second functional group, such as a hydroxy group or a sulfonate group, which can be attached directly or indirectly to a carbon atom on the aromatic moiety.

Preferred examples of aromatic carboxylic acids are salicylic acids and sulfurised derivatives thereof, such as hydrocarbyl substituted salicylic acid and derivatives thereof.

Processes for sulfurizing, for example a hydrocarbyl-substituted salicylic acid, are known to those skilled in the art.

Salicylic acids are typically prepared by carboxylation, for example, by the Kolbe-Schmitt process, of phenoxides, and in that case, will generally be obtained, normally in a diluent, in admixture with uncarboxylated phenol.

Preferred substituents for oil-soluble salicylic acids are alkyl substituents. In alkyl-substituted salicylic acids, the alkyl groups advantageously contain 5 to 100, preferably 9 to 30, especially 14 to 20, carbon atoms. Where there is more than one alkyl group, the average number of carbon atoms in all of the alkyl groups is preferably at least 9 to ensure adequate oil-solubility.

The metal detergent may be neutral or overbased, which terms are known in the art. A detergent additive composition may comprise one or more detergent additives, which can be a neutral detergent, an overbased detergent or a mixture of both.

Total Base Number (TBN) of detergents range from 15 to 600.

The detergents of the present invention may be salts of one type of organic acid or salts of more than one type of organic acids, for example hybrid complex detergents.

A hybrid complex detergent is a detergent in which the basic material, e.g. colloidal metal carbonate, within the detergent is stabilised by metal salts of more than one type of organic acid. It will be appreciated by one skilled in the art that a single type of organic acid may contain a mixture of organic acids of the same type. For example, a sulfonic acid may contain a mixture of sulfonic acids of varying molecular weights. Such an organic acid composition is considered as one type. Thus, complex detergents are distinguished from mixtures of two or more separate detergents, an example of such a mixture being one of an overbased calcium salicylate detergent with an overbased calcium phenate detergent.

The art describes examples of overbased complex detergents. For example, International Patent Application Publication Nos. WO 97/46643/4/5/6 and 7, which are incorporated herein in respect of the description and definition of the hybrid complex detergents, describe hybrid complexes made by neutralising a mixture of more than one acidic organic compound with a basic metal compound, and then overbasing the mixture. Individual basic material of the detergent are thus stabilised by a plurality of organic acid types. Examples of hybrid complex detergents include calcium phenate-salicylate-sulfonate detergent, calcium phenate-sulfonate detergent and calcium phenate-salicylate detergent.

EP-A-0 750 659 describes a calcium salicylate phenate complex made by carboxylating a calcium phenate and then sulfurising and overbasing the mixture of calcium salicylate and calcium phenate. Such complexes may be referred to as "phenalates"

A detergent additive composition contains two or more detergents, for example, an alkali metal, such as sodium, detergent, and an alkaline earth metal, such as calcium and/or magnesium, detergent. For the avoidance of doubt, the detergent additive composition may also comprise an ashless detergent, i.e. a non-metal containing detergent, typically in the form of an organic salt of an organic acid. The detergents are preferably metal-containing, wherein Group 1 and Group 2 metals are preferred, more preferably calcium and magnesium, especially calcium.

Preferably the detergent composition comprises at least one overbased metal detergent, irrespective of whether the detergent contains metal salts of one type of organic acid or metal salts of more than one type of organic acid.

Detergent additive compositions comprising, preferably consisting essentially of, at least one metal detergent based on one or more organic acids not containing sulfur, e.g., carboxylic acid, salicylic acid, alkylene bridged phenols and Mannich base-condensed phenol, are preferred. Especially, salicylate-based detergent have been found to be particularly effective. Therefore, detergent compositions comprising only metal, preferably calcium, salicylate-based detergents, whether neutral or overbased, are advantageous.

The detergent additive composition preferably contains two or more detergents, preferably at least one detergent having a TBN greater than 150 and at least one detergent having a TBN of at most 150.

Typically, one or more detergents are used in a lubricating oil composition in such an amount that they provide 3 to 15, preferably 5 to 12, especially 7 to 10, TBN.

Other Additives

Examples of other additives include anti-wear agents, antioxidants, friction modifiers, rust inhibitors, corrosion inhibitors, pour point depressants, anti-foaming agents and viscosity modifiers.

Anti-wear agents reduce friction and excessive wear and are usually based on compounds containing sulfur or phosphorus or both. Dihydrocarbyl dithiophosphate metal salts are frequently used as anti-wear and antioxidant agents. The metal may be an alkali or alkaline earth metal, or aluminum, lead, tin, molybdenum, manganese, nickel or copper. The zinc salts (ZDDP) are most commonly used in lubricating oil in amounts of 0.1 to 10 wt %, preferably 0.2 to 2 wt. %, based upon the total weight of the lubricating oil composition. They may be prepared in accordance with known techniques by first forming a dihydrocarbyl dithiophosphoric acid (DDPA), usually by reaction of one or more alcohols or a phenol with $P_2S_5$ and then neutralizing the formed DDPA with a zinc compound. For example, a dithiophosphoric acid may be made by reacting mixtures of primary and secondary alcohols having 1 to 18, preferably 2 to 12, carbon atoms. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound may be used, but the oxides, hydroxides and carbonates are most generally employed. Commercial additives frequently contain an excess of zinc due to use of an excess of the basic zinc compound in the neutralization reaction.

ZDDP provides excellent wear protection at a comparatively low cost and also functions as an antioxidant. Preferably a zinc dithiophosphate composition comprising one or more zinc dithiophosphates, which composition especially contains a mixture of primary and secondary alkyl groups, wherein the secondary alkyl groups are in a major molar proportion, such as at least 60, advantageously at least 75, more especially at least 85, mole %, based on the amount of alkyl groups, is useful in the present invention. Preferably a zinc dithiophosphate composition has 90 mole % secondary alkyl groups and 10 mole % primary alkyl groups.

Anti-oxidants increase the composition's resistance to oxidation and may work by combining with and modifying peroxides to render them harmless by decomposing peroxides or by rendering an oxidation catalyst inert. They may be classified as radical scavengers (e.g. sterically hindered phenols, secondary aromatic amines, and organo-copper salts); hydroperoxide decomposers (e.g. organo-sulfur and organophosphorus additives); and multifunctionals. Such anti-oxidants (or oxidation inhibitors) include hindered phenols, aromatic amine compounds, alkaline earth metal and metal-free alkylphenolthioesters having preferably $C_5$ to $C_{12}$ alkyl side chains, ashless alkylene-bridged phenols, phosphosulfurized and sulfurized hydrocarbons, phosphorous esters, metal and metal-free thiocarbamates & derivatives thereof, oil-soluble copper compounds as described in U.S. Pat. No. 4,867,890, and molybdenum-containing compounds. In the practice of the present invention, the use or otherwise of certain anti-oxidants may confer certain benefits. For example, in one embodiment it is preferred that an anti-oxidant composition comprising a hindered phenol with an ester group is used. In another embodiment, it is preferred to employ an anti-oxidant composition comprising a secondary aromatic amine and said hindered phenol.

Preferably an antioxidant composition comprising an aromatic amine, such as diphenylamine and/or a hindered phenol compound, such as 3,5-bis(alkyl)-4-hydroxyphenyl carboxylic acid esters, e.g. IRGANOX® L135 as sold by Ciba Speciality Chemicals, is useful. Usually, one or more antioxidants are used in an amount of 0.1 to 0.8, such as 0.2 to 0.6, preferably 0.3 to 0.5, mass %, based on the mass of the oil composition.

Friction modifiers include boundary additives that lower friction coefficients and hence improve fuel economy. Examples are esters of polyhydric alcohols such as glycerol monoesters of higher fatty acids, for example glycerol monooleate; esters of long chain polycarboxylic acids with diols, for example the butane diol esters of dimerized unsaturated fatty acids; oxazoline compounds; and alkoxylated alkyl-substituted mono-amines, and alkyl ether amines, for example, ethoxylated tallow amine and ethoxylated tallow ether amine. Molybdenum-containing compounds are also examples of friction modifiers. Conventionally, one or more organic friction modifiers are used in an amount of 0.1 to 0.5, such as 0.2 to 0.4, mass %, based on the mass of the oil composition.

The molybdenum-containing compounds, preferably molybdenum-sulfur compounds, useful in the present invention may be mononuclear or polynuclear. In the event that the compound is polynuclear, the compound contains a molybdenum core consisting of non-metallic atoms, such as sulfur, oxygen and selenium, preferably consisting essentially of sulfur.

To enable the molybdenum-sulfur compound to be oil-soluble or oil-dispersible, one or more ligands are bonded to a molybdenum atom in the compound. The bonding of the ligands includes bonding by electrostatic interaction as in the case of a counter-ion and forms of bonding intermediate between covalent and electrostatic bonding. Ligands within the same compound may be differently bonded. For example, a ligand may be covalently bonded and another ligand may be electrostatically bonded.

Preferably, the or each ligand is monoanionic and examples of such ligands are dithiophosphates, dithiocarbamates, xanthates, carboxylates, thioxanthates, phosphates and hydrocarbyl, preferably alkyl, derivatives thereof. Preferably, the ratio of the number of molybdenum atoms, for example, in the core in the event that the molybdenum-sulfur compound is a polynuclear compound, to the number of monoanionic ligands, which are capable of rendering the compound oil-soluble or oil-dispersible, is greater than 1 to 1, such as at least 3 to 2.

The molybdenum-sulfur compound's oil-solubility or oil-dispersibility may be influenced by the total number of carbon atoms present among all of the compound's ligands. The total number of carbon atoms present among all of the hydrocarbyl groups of the compound's ligands typically will be at least 21, e.g., 21 to 800, such as at least 25, at least 30 or at least 35. For example, the number of carbon atoms in each alkyl group will generally range between 1 to 100, preferably 1 to 40, and more preferably between 3 and 20.

Examples of molybdenum-sulfur compounds include dinuclear molybdenum-sulfur compounds and trinuclear molybdenum-sulfur compounds.

An example of a dinuclear molybdenum-sulfur compound is represented by the formula:

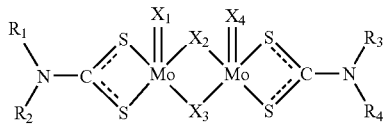

where $R_1$ to $R_4$ independently denote a straight chain, branched chain or aromatic hydrocarbyl group having 1 to 24 carbon atoms; and $X_1$ to $X_4$ independently denote an oxygen atom or a sulfur atom. The four hydrocarbyl groups, $R_1$ to $R_4$, may be identical or different from one another.

Preferably the molybdenum-sulfur compound has a core of the structures depicted in (I) or (II):

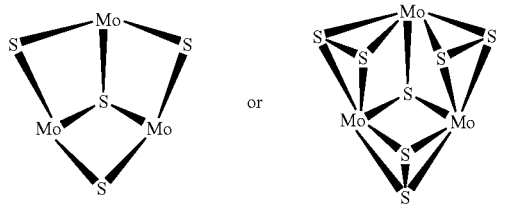

Each core has a net electrical charge of +4.

In a preferred embodiment, the molybdenum-sulfur compound is an oil-soluble or oil-dispersible trinuclear molybdenum-sulfur compound. Examples of trinuclear molybdenum-sulfur compounds are disclosed in WO98/26030, WO99/31113, WO99/66013, EP-A-1 138 752, EP-A-1 138 686 and European patent application no. 02078011, each of which are incorporated into the present description by reference, particularly with respect to the characteristics of the molybdenum compound or additive disclosed therein.

Preferably, the trinuclear molybdenum-sulfur compounds are represented by the formula $Mo_3S_kE_xL_nA_pQ_z$, wherein:

k is an integer of at least 1;

E represents a non-metallic atom selected from oxygen and selenium;

x can be 0 or an integer, and preferably k+x is at least 4, more preferably in the range of 4 to 10, such as 4 to 7, most preferably 4 or 7;

L represents a ligand that confers oil-solubility or oil-dispersibility on the molybdenum-sulfur compound, preferably L is a monoanionic ligand;

n is an integer in the range of 1 to 4;

A represents an anion other than L, if L is an anionic ligand;

p can be 0 or an integer;

Q represents a neutral electron-donating compound; and z is in the range of 0 to 5 and includes non-stoichiometric values.

Those skilled in the art will realise that formation of the trinuclear molybdenum-sulfur compound will require selection of appropriate ligands (L) and other anions (A), depending on, for example, the number of sulfur and E atoms present in the core, i.e. the total anionic charge contributed by sulfur atom(s), E atom(s), if present, L and A, if present, must be −12. The trinuclear molybdenum-sulfur compound may also have a cation other than molybdenum, for example, (alkyl) ammonium, amine or sodium, if the anionic charge exceeds −12.

Examples of Q include water, alcohol, amine, ether and phosphine. It is believed that the electron-donating compound, Q, is merely present to fill any vacant coordination sites on the trinuclear molybdenum-sulfur compound.

Examples of A can be of any valence, for example, monovalent and divalent and include disulfide, hydroxide, alkoxide, amide and thiocyanate or derivative thereof; preferably A represents a disulfide ion.

Preferably, L is monoanionic ligand, such as dithiophosphates, dithiocarbamates, xanthates, carboxylates, thioxanthates, phosphates and hydrocarbyl, preferably alkyl, derivatives thereof. When n is 2 or more, the ligands can be the same or different.

In an embodiment, independently of the other embodiments, k is 4 or 7, n is either 1 or 2, is a monoanionic ligand, p is an integer to confer electrical neutrality on the compound based on the anionic charge on A and each of x and z is 0.

In a further embodiment, independently of the other embodiments, k is 4 or 7, L is a monoanionic ligand, n is 4 and each of p, x and z is 0.

The molybdenum-sulfur cores, for example, the structures depicted in (I) and (II) above, may be interconnected by means of one or more ligands that are multidentate, i.e. a ligand having more than one functional group capable of binding to a molybdenum atom, to form oligomers. Molybdenum-sulfur additives comprising such oligomers are considered to fall within the scope of this invention.

Other examples of molybdenum containing compounds include molybdenum carboxylates and molybdenum nitrogen complexes, both of which may be sulfurised.

In an embodiment, a molybdenum-containing compound, such as a trinuclear molybdenum dithiocarbamate, and a glycerol monoester of carboxylic, e.g., oleic, acid is preferred.

Boron may also be present in the lubricating oil compositions of the present invention. Boron-containing additives may be prepared by reacting a boron compound with an oil-soluble or oil-dispersible additive or compound. Boron compounds include boron oxide, boron oxide hydrate, boron trioxide, boron trifluoride, boron tribromide, boron trichloride, boron acid such as boronic acid, boric acid, tetraboric acid and metaboric acid, boron hydrides, boron amides and various esters of boron acids. Examples of boron-containing additives include a borated dispersant; a borated dispersant VI improver; an alkali metal or a mixed alkali metal or an alkaline earth metal borate; a borated overbased metal detergent; a borated epoxide; a borate ester; a sulfurised borate ester; and a borate amide. A preferred boron-containing additive is a borated dispersant.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1,3,4-thiadiazoles such as those described in U.S. Pat. Nos. 2,719,125; 2,719,126; and 3,087,932; are typical. Other similar material are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in U.K. Patent Specification No. 1,560,830. Benzotriazoles derivatives also fall within this class of additives. When these compounds are included in the lubricating composition, they are preferably present in an amount not exceeding 0.2 wt. % active ingredient.

A small amount of a demulsifying component may be used. A preferred demulsifying component is described in EP-A-330 522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil improvers, lower the minimum temperature at which the fluid will flow or can be poured. Such additives are well known. Typical of those additives which improve the low temperature fluidity of the fluid are $C_8$ and $C_{18}$ dialkyl fumarate/vinyl acetate copolymers, polyalkylmethacrylates and the like.

Foam control can be provided by many compounds including an antifoamant of the polysiloxane type, for example, silicone oil or polydimethyl siloxane.

Viscosity index improvers (or viscosity modifiers) impart high and low temperature operability to a lubricating oil and permit it to remain shear stable at elevated temperatures and also exhibit acceptable viscosity or fluidity at low temperatures. Suitable compounds for use as viscosity modifiers are generally high molecular weight hydrocarbon polymers, e.g. polyisobutylene, copolymers of ethylene and propylene and higher alpha-olefins; polyesters, such as polymethacrylates; hydrogenated poly(styrene-co-butadiene or -isoprene) polymers and modifications (e.g., star polymers); and esterified poly(styrene-co-maleic anhydride) polymers . Oil-soluble viscosity modifying polymers generally have number average molecular weights of at least 15,000 to 1,000,000, preferably 20,000 to 600,000, as determined by gel permeation chromatography or light scattering methods. The disclosure in Chapter 5 of "Chemistry & Technology of Lubricants", edited by R. M. Mortier and S. T. Orzulik, First edition, 1992, Blackie Academic & Professional, is incorporated herein. The VM used may have that sole function, or may be multifunctional, such as demonstrating viscosity index improving properties as well as dispersant properties. Dispersant olefin copolymers and dispersant polymethacrylates are examples of dispersant viscosity index improver additives. Dispersant viscosity index improver additives are prepared by chemically attaching various functional moieties, for example amines, alcohols and amides, onto polymers, which polymers preferably tend to have a number average molecular weight of at least 15,000, such in the range from 20,000 to 600,000, as determined by gel permeation chromatography or light scattering methods. The polymers used may be those described below with respect to viscosity modifiers. Therefore, amine molecules may be incorporated to impart dispersancy and/or antioxidancy characteristics, whereas phenolic molecules may be incorporated to improve antioxidant properties. A specific example, therefore, is an inter-polymer of ethylene-propylene post grafted with an active monomer such as maleic anhydride and then derivatized with, for example, an alcohol or amine. In the event a dispersant viscosity modifier is used in the present invention, the nitrogen content of the lubricating oil composition also includes that derived from the dispersant viscosity modifier. An example of a dispersant viscosity modifier is Hitec® 5777, which is manufactured and sold by Ethyl Corp. EP-A-24146 and EP-A-0 854 904 describe examples of dispersant viscosity index improvers, which are accordingly incorporated herein. Generally, viscosity modifiers, whether multifunctional or not, are used in an amount depending on the desired viscometric grade (e.g., SAE 10W-40) of the lubricating oil composition, for example, an amount of 0.001 to 2, preferably 0.01 to 1.5, such as 0.1 to 1, mass % of the polymer, based on the mass of the oil composition.

Representative effective amounts of such additives, when used in lubricating oil compositions, are as follows:

| Additive | Mass % a.i.* (Broad) | Mass % a.i.* (Preferred) |
|---|---|---|
| Viscosity Modifier | 0.01-6 | 0.01-4 |
| Corrosion Inhibitor | 0.0-5 | 0.01-1.5 |
| Oxidation Inhibitor | 0.01-5 | 0.01-1.5 |
| Friction Reducer | 0.01-5 | 0.01-1.5 |
| Dispersant | 0.1-20 | 0.1-8 |
| Multifuctional Viscosity Modifier | 0.0-5 | 0.05-5 |
| Detergent | 0.01-6 | 0.01-3 |
| Anti-wear Agent | 0.01-6 | 0.01-4 |
| Pour Point Depressant | 0.01-5 | 0.01-1.5 |
| Rust Inhibitor | 0.0-0.5 | 0.001-0.2 |
| Anti-Foaming Agent | 0.001-0.3 | 0.001-0.15 |
| Demulsifier | 0.0-0.5 | 0.001-0.2 |

*mass % active ingredient based on the final lubricating oil composition.

Additive Concentrate

An additive concentrate constitutes a convenient means of handling two or more additives before their use, as well as facilitating solution or dispersion of the additives in lubricant compositions. When preparing a lubricant composition that contains more than one type of additive (sometimes referred to as "additive components"), each additive may be incorporated separately. In many instances, however, it is convenient to incorporate the additives as an additive concentrate (a so-called additive "package" (also referred to as an "adpack")) comprising two or more additives.

In the preparation of the lubricant oil compositions, it is common practice to introduce additives therefor in the form of additive concentrate(s) containing the additives. When a plurality of additives is employed it may be desirable, although not essential, to prepare one or more additive concentrates comprising the additives, whereby several additives, with the exception of viscosity modifiers, multifuntional viscosity modifiers and pour point depressants, can be added simultaneously to the oil of lubricating viscosity to form the lubricating oil composition. Dissolution of the additive concentrate(s) into the lubricating oil may be facilitated by diluent or solvents and by mixing accompanied with mild heating, but this is not essential. The additive concentrate(s) will typically be formulated to contain the additive(s) in proper amounts to provide the desired concentration in the final formulation when the additive concentrate(s) is/are combined with a predetermined amount of oil of lubricating viscosity. If required, the viscosity modifiers, or multifuntional viscosity modifiers, and pour point depressants are then separately added to form a lubricating oil composition.

The mass % based on active ingredient, of the additives, in an additive concentrate may be in a range that commences at 5, 8 or 10 and that terminates at 12, 15 or 20 (which commencement and termination values may be independently combined), the remainder being an oleaginous carrier or diluent fluid (for example, an oil of lubricating viscosity). The final lubricating oil composition may typically contain 5 to 40 mass % of the additive concentrate(s).

The amount of additives in the final lubricating oil composition is generally dependent on the type of the oil composition. For example, a heavy duty diesel engine lubricating oil composition preferably has 7 to 22, more preferably 8 to 16, such as 8 to 14, mass % of additives (including any diluent fluid), based on the mass of the oil composition. A passenger car engine lubricating oil composition, for example, a gasoline or a diesel engine oil composition, tends to have a lower amount of additives, for example 2 to 16, such as 3 or 4 to 14, preferably 5 to 12, especially 6 to 10, mass % of additives, based on the mass of the oil composition. The amounts expressed above exclude non-hydrogenated olefin polymer, viscosity modifier and pour point depressant additives.

Generally the viscosity of the additive concentrate is higher than that of the lubricating oil composition. Typically, the kinematic viscosity at 100° C. of the additive concentrate is at least 50, such as in the range 100 to 200, preferably 120 to 180, $mm^2s^{-1}$.

Thus, a method of preparing a lubricating oil composition according to the present invention can involve admixing an oil of lubricating viscosity and one or more additives or additive concentrates that comprises two or more of additives and then, admixing other additive components, such as viscosity modifier, and optionally a multifunctional viscosity modifier and pour point depressant.

Lubricating oil compositions of the present invention may also be prepared by admixing an oil of lubricating viscosity, an additive concentrate containing two or more additive components, a non-hydrogenated olefin polymer and a viscosity modifier, and optionally a multifunctional viscosity modifier and pour point depressant.

The phosphorus and sulfur content of the lubricating oil composition is advantageously derived from additives in the lubricating oil composition, such as a zinc dithiophosphate.

It should be appreciated that interaction may take place between any two or more of the additives, including any two or more detergents, after they have been incorporated into the oil composition. The interaction may take place in either the process of mixing or any subsequent condition to which the composition is exposed, including the use of the composition in its working environment. Interactions may also take place when further auxiliary additives are added to the compositions of the invention or with components of oil. Such interaction may include interaction which alters the chemical constitution of the additives. Thus, the compositions of the invention include compositions in which interaction, for example, between any of the additives, has occurred, as well as compositions in which no interaction has occurred, for example, between the components mixed in the oil.

The lubricating oil compositions may be used to lubricate mechanical engine components, particularly an internal combustion, such as a compression-ignited, engine, by adding the lubricating oil thereto. Particular examples of compression-ignited engines are those developed in recent years where the top ring groove temperature may exceed 150, preferably exceed 250, ° C., due to increases in specific power output to around 5 or greater, such as 25 or greater, preferably at least 30, especially 40 or greater, kW/liter. Preferably the maximum specific power output is around 60 kW/litre. These engines are more prone to suffer from ring-sticking problems in their operation.

In a preferred embodiment, the multigrade crankcase lubricating oil composition comprises:

(A) an oil of lubricating viscosity, at least 50% by mass of which is a mineral oil, which oil contains in a major amount a basestock selected from Group III and Group IV, and optionally also contains a minor amount of Group V basestock in the form of an ester;

(B) a non-hydrogenated aliphatic olefin polymer, such as a polyisobutene, in an amount of less than 10 mass %, based on the mass of the oil composition, said polymer having a number average molecular weight in the range of 100 to 5,000;

(C) a dispersant additive composition containing a borated and non-borated succinimide;

(D) a detergent additive composition selected from (i) calcium and magnesium detergents and (ii) one or more calcium detergents based on one or more organic acids not containing sulfur, such as calcium salicylates;

(E) an antiwear composition containing a major proportion of a zinc dithiophosphate having secondary alkyl groups, an antioxidant composition selected from one or more aromatic amines and hindered phenol compounds, and a friction modifier composition consisting of a molybdenum dithiocarbamate and carboxylic acid ester compound; and (F) a viscosity modifier selected from olefin copolymers and hydrogenated poly(styrene-co-isoprene) polymers and modifications thereof.

In this specification:

The term "hydrocarbyl" as used herein means that the group concerned is primarily composed of hydrogen and carbon atoms and is bonded to the remainder of the molecule via a carbon atom, but does not exclude the presence of other atoms or groups in a proportion insufficient to detract from the substantially hydrocarbon characteristics of the group.

The term "comprising" or "comprises" when used herein is taken to specify the presence of stated features, integers, steps or components, but does not preclude the presence or addition of one or more other features, integers, steps, components or groups thereof. In the instance the term "comprising" or comprises" is used herein, the term "consisting essentially of" and its cognates are a preferred embodiment, while the term "consisting of" and its cognates are a preferred embodiment of the term "consisting essentially of".

The term "oil-soluble" or "oil-dispersible", as used herein, does not mean that the additives are soluble, dissolvable, miscible or capable of being suspended in the oil in all proportions. They do mean, however, that the additives are, for instance, soluble or stable dispersible in the oil to an extent sufficient to exert their intended effect in the environment in which the oil composition is employed. Moreover, the additional incorporation of other additives such as those described above may affect the solubility or dispersibility of the additives.

"Major amount" "Major amount" means in excess of 50, such as greater than 70, preferably 75 to 97, especially 80 to 95 or 90, mass %, of the composition.

"Minor amount" means less than 50, such as less than 30, for example, 3 to 25, preferably 5 or 10 to 20, mass %, of the composition mass % of the composition.

The term "molybdenum-sulfur compound" means a compound having at least one molybdenum atom and at least one sulfur atom. Preferably the compound has at least one sulfur atom that is bonded to one or more molybdenum atoms and also bonded to one or more non-molybdenum atoms, such as carbon. More preferably the compound has at least one sulfur atom that is bonded to one or more molybdenum atoms only, such as represented by cores $[Mo_2S_4]$, $[MO_3S_4]$ and $[Mo_3S_7]$. Atoms selected from oxygen and selenium may replace one or more sulfur atoms in such cores. Advantageously, the core consists of molybdenum and sulfur atoms alone. Accordingly, the term "molybdenum-sulfur additive" means an additive comprising one or more molybdenum-sulfur compounds.

All percentages reported are mass % on an active ingredient basis, i.e. without regard to carrier or diluent oil, unless otherwise stated.

The abbreviation SAE stands for the Society of Automotive Engineers, which classifies lubricants by viscosity grades.

EXAMPLES

The invention will now be particularly described, by way of example only, as follows:—

Preparation of Lubricating Oil Compositions

Two lubricating oil compositions (Oil 1 and Oil A) were prepared to SAE 5W-30 grade, by methods known in the art, by blending an additive package, a basestock mixture containing a Group II basestock (4.5 mass%) and a Group III basestock (75.0 and 78.5 mass% respectively), and a viscosity modifier and a pour point depressant.

Each oil contained the same type and amount of additive components, except that Oil 1 contained also a polyisobutene polymer having number average molecular weight of 2225 (4 mass %), and a smaller amount of viscosity modifier. Each oil had a phosphorus content of 0.050 mass %, and gave an ash content of 0.721 mass %.

Tests and Results

Samples of each of Oils A and 1 were subjected to an engine test used to investigate deposit formation, based specifically on the VWTDi CEC-L-78-T-99 test, also known as the PV1452 test. The test is regarded as an industry standard and as a severe assessment of a lubricant's performance capabilities.

The test employs a 4-cylinder, 1.9 litre, 81 kW passenger car diesel engine. It is a direct injection engine, in which a turbocharger system is used to increase the power output of the unit. The industry test procedure consists of a repeating cycle of hot and cold running conditions—the so-called PK cycle. This involves a 30 minute idle period at zero load followed by 180 minutes at full load and 4150 rpm. In the standard test, the entire cycle is then repeated for a total of 54 hours. In this 54 hour period the initial oil fill of 4.5 liters of test lubricant is not topped up.

At the end of the 54 hour test, the engine is drained, the engine disassembled and the pistons rated for piston deposits and piston ring sticking. This affords a result which is assessed relative to an industry reference oil (RL206) to define passing or failing performance.

The pistons are rated against what is known as the DIN rating system. The three piston-ring grooves and the two piston lands that lie between the grooves are rated on a merit scale for deposits and given a score out of 100 by a method known to those skilled in the art. In summary, the higher the number the better the performance: 100 indicates totally clean and 0 indicates totally covered with deposit. The five scores are then averaged to give the overall piston cleanliness merit rating. The scores for each of the four pistons are then averaged to afford the overall piston cleanliness for the test.

As indicated, these results are judged relative to an industry reference oil (RL206) to define passing performance. Table 1 below illustrates the results of the two oils.

TABLE 1

| Example | Oil A | Oil 1 |
|---|---|---|
| VW TDi, merit @ 54 hrs | 54 | 63 |

The data demonstrate that the use of a non-hydrogenated olefin polymer provides superior piston cleanliness in a lubricating oil composition having reduced phosphorus and ash.

Additional lubricating oil compositions were assessed for their performance in a modified test procedure (see Table 2 below), in which the engine was stopped every 12 hours, drained, stripped and rated, and re-assembled; the original test oil was put back into the engine which was then restarted. The rating at 48 hours is reported in Table 2. SAE 2002-01-2678 describes the modified procedure used.

Lubricating oil compositions (Oils B and 2 to 6) were blended to SAE 5W-30 oils, having about 0.1% phosphorus, about 0.35% sulfur and about 1.2% ash, from an additive package, a basestock mixture consisting of Group III basestock, and a viscosity modifier and a pour point depressant. Each oil contained the same type and amount of additive components, except that Oils 2 to 6 contained also a polyisobutene polymer (see Table 2), and smaller amount of viscosity modifier than Oil B.

TABLE 2

| | Example | | | | | |
|---|---|---|---|---|---|---|
| | B | 2 | 3 | 4 | 5 | 6 |
| PIB, mass % | 0 | 6 | 12 | 4 | 6.3 | 4 |
| PIB, Mn | — | 450 | 450 | 950 | 950 | 2200 |
| PIB, KV 100° C., $mm^2s^{-1}$ | — | 9.4 | 9.4 | 210 | 210 | 2150 |
| VWTDi merit @ 48 hrs | 59 | 68 | 65 | 62 | 68 | 69 |

The data in Table 2 support the finding that the use of a non-hydrogenated olefin polymer in a lubricating oil composition unexpectedly improves the piston cleanliness of an internal combustion engine.

What is claimed is:

1. A multigrade crankcase lubricating oil composition having a sulfated ash content of at least 0.2 mass %, comprising, or made by admixing:

(A) a major amount of oil of lubricating viscosity, at least 50% by mass of which is Group III mineral oil, and no greater than 25% by mass of which is a Group I, Group II or Group IV basestock; and minor amounts of:

(B) a non-hydrogenated olefin polymer in an amount of 1 to 15 mass %, based on the mass of the oil composition, said polymer having a number average molecular weight in the range of 100 to 5,000;

(C) a dispersant;

(D) a metal detergent;

(E) one or more other lubricant additive components selected from anti-oxidants, anti-wear agents and friction modifiers, and (F) a viscosity modifier.

2. The composition as claimed in claim 1 wherein the non-hydrogenated olefin polymer has at most 10% of the polymer chains possessing a terminal double bond.

3. The composition as claimed in claim 1 wherein the number average molecular weight of the non-hydrogenated olefin polymer is in the range of 300 to 3000.

4. The composition as claimed in claim 1 wherein the non-hydrogenated olefin polymer is derived from C3 to C8 olefins.

5. The composition as claimed in claim 1 wherein the non-hydrogenated olefin polymer has a kinematic viscosity at 100° C. of at least 9 $mm^2s^{-1}$.

6. The composition as claimed in claim 1 wherein the composition has a phosphorus content of 0.005 to 0.08 mass %; a sulfur content of 0.05 to 0.4 mass %; and gives a sulfated ash content of at most 1.0 mass %, each based on the mass of the oil composition.

7. A method of lubricating a compression-ignited internal combustion engine comprising operating the engine and lubricating the engine with a lubricating oil composition as claimed in claim 1.

8. A method of improving piston cleanliness of a compression-ignited internal combustion engine comprising adding to the engine a lubricating oil composition as claimed in claim 1.

9. A compression-ignited internal combustion engine, lubricated with a lubricating oil composition as claimed in claim 1.

10. The composition as claimed in claim 1 comprising 3 to 8 mass % of said non-hydrogenated olefin polymer.

11. The composition as claimed in claim 2 wherein 5 to 10% of the polymer chains of said non-hydrogenated olefin polymer possess a terminal double bond.

12. The composition as claimed in claim 3 wherein the number average molecular weight of the non-hydrogenated olefin polymer is in the range of 800 to 2500.

13. The composition as claimed in claim 4 wherein the non-hydrogenated olefin polymer is derived from butane or iso-butene.

14. The composition as claimed in claim 5 wherein the non-hydrogenated olefin polymer has a kinematic viscosity at 100° C. of at 150 to 3000 $mm^2s^{-1}$.

15. The composition as claimed in claim 1 wherein the composition has a phosphorus content of 0.01 to 0.07 mass %; a sulfur content of 0.1 to 0.3 mass %; and gives a sulfated ash content of 0.2 to 0.8 mass %, each based on the mass of the oil composition.

16. The composition as claimed in claim 1 wherein the composition has a phosphorus content of 0.03 to 0.06 mass %; a sulfur content of 0.15 to 0.2 mass %; and gives a sulfated ash content of 0.3 to 0.6 mass %, each based on the mass of the oil composition.

* * * * *

UNITED STATES PATENT AND TRADEMARK OFFICE

CERTIFICATE OF CORRECTION

PATENT NO. : 7,838,470 B2
APPLICATION NO. : 10/909141
DATED : November 23, 2010
INVENTOR(S) : Robert W. Shaw et al.

It is certified that error appears in the above-identified patent and that said Letters Patent is hereby corrected as shown below:

In claim 14, line 3, after "100°C. of at", insert --least--.

Signed and Sealed this
Twenty-fifth Day of January, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,838,470 B2
APPLICATION NO. : 10/909141
DATED : November 23, 2010
INVENTOR(S) : Robert W. Shaw et al.

It is certified that error appears in the above-identified patent and that said Letters Patent is hereby corrected as shown below:

Column 20, line 45, (claim 14, line 3), after "100°C. of at", insert --least--.

This certificate supersedes the Certificate of Correction issued January 25, 2011.

Signed and Sealed this
Fifteenth Day of February, 2011

David J. Kappos

David J. Kappos
*Director of the United States Patent and Trademark Office*